US010144884B2

(12) United States Patent
Hoehn

(10) Patent No.: US 10,144,884 B2
(45) Date of Patent: Dec. 4, 2018

(54) TWO STAGE HYDROCRACKING PROCESS AND APPARATUS

(71) Applicant: UOP LLC, Des Plaines, IL (US)

(72) Inventor: Richard K. Hoehn, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 191 days.

(21) Appl. No.: 15/144,690

(22) Filed: May 2, 2016

(65) Prior Publication Data

US 2016/0369183 A1 Dec. 22, 2016

Related U.S. Application Data

(60) Provisional application No. 62/181,478, filed on Jun. 18, 2015.

(51) Int. Cl.
*C10G 67/02* (2006.01)
*C10G 65/10* (2006.01)

(52) U.S. Cl.
CPC ..... *C10G 65/10* (2013.01); *C10G 67/02* (2013.01)

(58) Field of Classification Search
CPC ..... C10G 2300/1092; C10G 45/44; C10G 65/12; C10G 2400/10; C10G 65/10; B01D 3/141
See application file for complete search history.

(56) References Cited

U.S. PATENT DOCUMENTS

| | | | | |
|---|---|---|---|---|
| 3,130,006 | A | 4/1964 | Rabo et al. | |
| 4,363,718 | A | 12/1982 | Klotz | |
| 6,726,832 | B1 | 4/2004 | Baldassari et al. | |
| 7,462,276 | B2 | 12/2008 | Wang et al. | |
| 7,803,334 | B1 | 9/2010 | Hoehn et al. | |
| 7,842,180 | B1 | 11/2010 | Leonard et al. | |
| 8,287,720 | B2 | 10/2012 | Baldassari et al. | |
| 8,333,884 | B2 | 12/2012 | Hunter et al. | |
| 9,388,347 | B2 * | 7/2016 | Ramaseshan ..... | C10G 65/10 |
| 2009/0095654 | A1 | 4/2009 | Gupta et al. | |
| 2014/0262941 | A1 | 9/2014 | Ramaseshan et al. | |

FOREIGN PATENT DOCUMENTS

CN 1952068 A 4/2007

OTHER PUBLICATIONS

Guan, C.-S., Wang, Z-X, Que, G.-H., Study on Two-Stage Suspended Bed Hydrocracking, Shiyou Xuebao, Shiyou Jiagong/Acta Petrolei Sinica (Petroleum Processing Section), vol. 18, Issue 4, Aug. 2002, pp. 38-42.

* cited by examiner

*Primary Examiner* — Sharon Pregler

(57) ABSTRACT

An apparatus and process is disclosed for hydrocracking a hydrocarbon feed in a hydrocracking reactor and hydrocracking a liquid first hydrocracked stream and a recycle oil stream in a second hydrocracking reactor. A vapor first hydrocracked stream and the second hydrocracked stream are fractionated to provide the recycle oil stream.

20 Claims, 1 Drawing Sheet

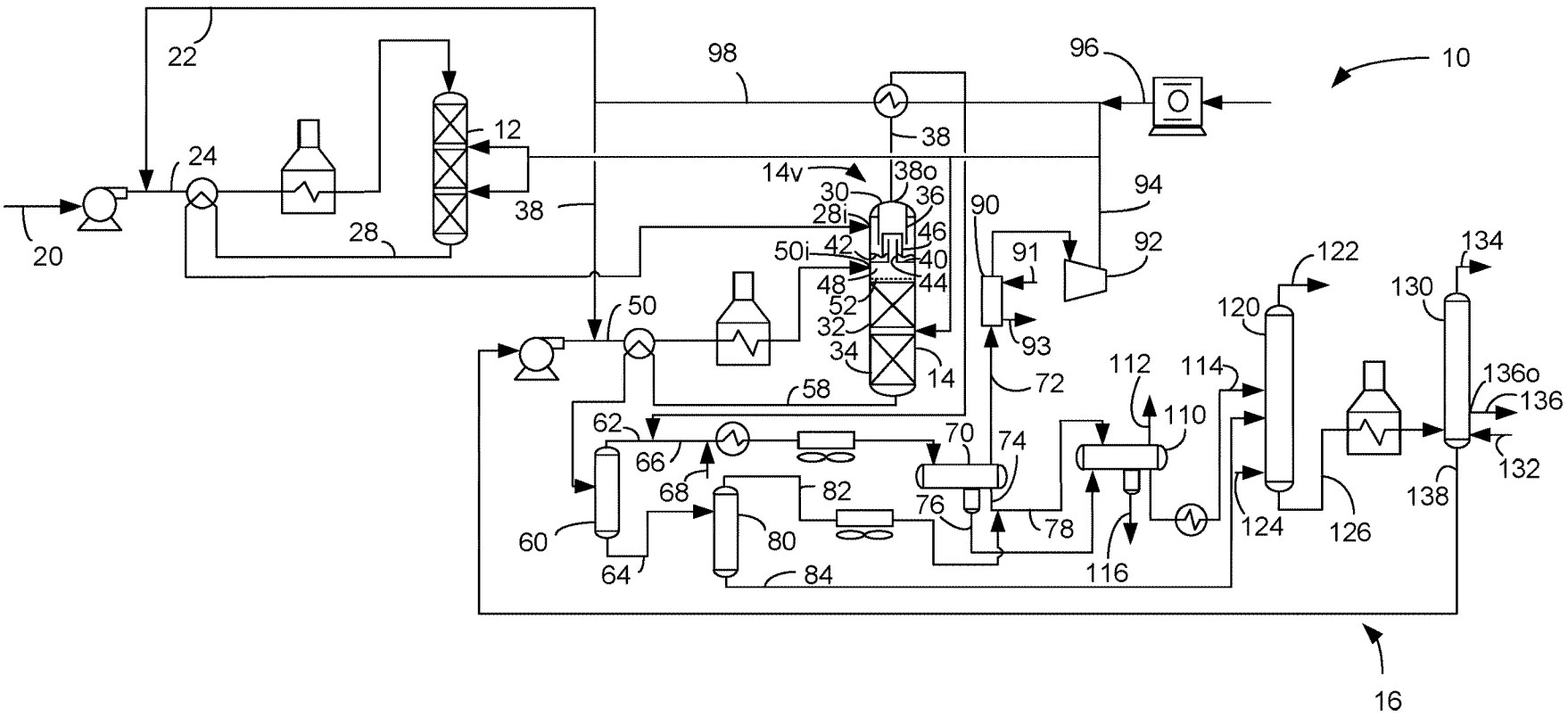
10
16
20
22
24
28
12
38
98
14v
50i
28i
30
38o
36
46
40
44
42
48
52
32
34
14
58
50
62
66
68
64
60
80
82
84
70
76
74
78
72
90
91
93
92
94
96
114
110
112
116
120
122
124
126
130
134
136o
136
132
138

TWO STAGE HYDROCRACKING PROCESS AND APPARATUS

CROSS-REFERENCE TO RELATED APPLICATION

This application claims priority from Provisional Application No. 62/181,478 filed Jun. 18, 2015, the contents of which are hereby incorporated by reference.

FIELD OF THE INVENTION

The field of the invention is hydrocracking.

BACKGROUND OF THE INVENTION

Hydrocracking can include processes which convert hydrocarbons in the presence of hydrocracking catalyst and hydrogen to more valuable products. Hydrocracking is a hydrocracking process in which hydrocarbons crack in the presence of hydrogen and hydrocracking catalyst to lower molecular weight hydrocarbons. Depending on the desired output, the hydrocracking zone may contain one or more beds of the same or different catalyst. Hydrocracking is a process used to crack hydrocarbon feeds such as vacuum gas oil (VGO) to diesel including kerosene and gasoline motor fuels.

Hydrocracking can be achieved in one or two stages. In two-stage hydrocracking, hydrocracked effluent from the first stage is fractionated and unconverted oil is fed to a second stage. In single-stage hydrocracking, unconverted oil is not fed to a second stage but may be recycled to the single stage. Two-stage hydrocracking units are more expensive than one-stage units because additional equipment is required. However a two-stage unit has the advantage of providing a clean reaction environment in the second stage because the sulfur and nitrogen have been removed from the feed in the first stage and the recycle gas is typically clean, having been scrubbed before use in the second stage. More sensitive and effective hydrocracking catalysts can be used in a clean environment.

There is a need, therefore, for improved processes and apparatuses that retain the advantages of a two-stage hydrocracking reactor which minimizes equipment and operational cost.

BRIEF SUMMARY OF THE INVENTION

In a process embodiment, the invention comprises hydrocracking a first hydrocarbon stream in the presence of a first hydrogen stream and a hydrocracking catalyst to produce a first hydrocracked stream; separating the first hydrocracked stream in a hydrocracking reactor vessel to provide a vapor first hydrocracked stream and a liquid first hydrocracked stream; and hydrocracking the liquid first hydrocracked stream and a recycle oil stream in the presence of a second hydrogen stream in the hydrocracking reactor vessel to provide a second hydrocracked stream.

In an apparatus embodiment, the invention comprises a first hydrocracking reactor; a second hydrocracking reactor in downstream communication with the first hydrocracking reactor; a separator in the second hydrocracking reactor; a fractionation column in downstream communication with the second hydrocracking reactor; and the second hydrocracking reactor in downstream communication with the fractionation column.

In a further process embodiment, the invention comprises hydrocracking a first hydrocarbon stream in the presence of a first hydrogen stream and a hydrocracking catalyst to produce a first hydrocracked stream; separating the first hydrocracked stream in a hydrocracking reactor vessel to provide a vapor first hydrocracked stream and a liquid first hydrocracked stream; hydrocracking the liquid first hydrocracked stream and a recycle oil stream in the presence of a second hydrogen stream in the hydrocracking reactor vessel to provide a second hydrocracked stream; and fractionating a portion of the second hydrocracked stream to provide the recycle oil stream

BRIEF DESCRIPTION OF THE DRAWING

The FIGURE is a schematic drawing of the process and apparatus of the present invention.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of the reflux or reboil to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T95" means the temperature at which 5 volume percent or 95 volume percent, as the case may be, respectively, of the sample boils using ASTM D-86.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, the term "diesel cut point" is between about 343° C. (650° F.) and about 399° C. (750° F.) using the TBP distillation method.

As used herein, the term "diesel boiling range" means hydrocarbons boiling in the range of between about 132° C. (270° F.) and the diesel cut point using the TBP distillation method.

As used herein, the term "diesel conversion" means conversion of feed that boils above the diesel cut point to material that boils at or below the diesel cut point in the diesel boiling range.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

It is proposed to incorporate the first and second stage hydrocracking reactors into a common unit. The gas phase from the first stage reactor, which contains the majority of hydrogen sulfide and ammonia is separated at the top of the second stage reactor and replaced by clean scrubbed recycle gas, thus allowing the catalyst in the second stage reactor to work in a cleaner environment. Unconverted oil from the second stage reactor is mixed along with the effluent liquid from the first stage reactor and both are processed in the second stage reactor. The hydrogen gas phase from the first stage reactor is separated from the liquid, and the recycle hydrogen gas for the second stage reactor is a clean, scrubbed recycle gas. The unconverted oil is kept separate from the first stage effluent prior to separation of the gas phase, so that absorption of hydrogen sulfide and ammonia from the first stage vapor phase into the recycled unconverted oil can be minimized. This requires introducing the unconverted oil at a different point in the second stage reactor from the first stage effluent liquid.

The apparatus and process 10 for hydrocracking hydrocarbons comprise a first hydrocracking reactor 12, a second hydrocracking reactor 14 and a fractionation section 16. A first hydrocarbon feed is first fed to the first hydrocracking reactor 12 which converts the feed to lower boiling hydrocarbons. The first hydrocracked stream is fractionated in the fractionation section 16. An unconverted, recycle oil stream from the fractionation section 16 is recycled to the second hydrocracking reactor 14.

A first hydrocarbon feed stream may be introduced in line 20. A first hydrogen stream in a first hydrogen line 22 may join the first hydrocarbon feed stream in line 20 to provide a first hydrocracking feed stream in line 24.

Illustrative hydrocarbon feedstocks for the first hydrocarbon feed stream include hydrocarbonaceous streams having components boiling above about 288° C. (550° F.), such as atmospheric gas oils, vacuum gas oil (VGO), deasphalted, vacuum, and atmospheric residua, coker distillates, straight run distillates, solvent-deasphalted oils, pyrolysis-derived oils, high boiling synthetic oils, cycle oils, hydrocracked feeds, cat cracker distillates and the like. These hydrocarbonaceous feed stocks may contain from about 0.1 to about 4 wt-% sulfur.

The most common of such conventional hydrocarbon streams is a VGO which is typically a hydrocarbon material having a boiling range with an IBP of at least about 232° C. (450° F.), a T5 of about 288° C. (550° F.) to about 343° C. (650° F.), a T95 between about 510° C. (950° F.) and about 570° C. (1058° F.) and an EP of no more than about 626° C. (1158° F.) prepared by vacuum fractionation of atmospheric residue. Atmospheric residue is an alternative feedstock boiling with an IBP of at least about 315° C. (600° F.), a T5 between about 340° C. (644° F.) and about 360° C. (680° F.) and a T95 of between about 700° C. (1292° F.) and about 900° C. (1652° F.) obtained from the bottoms of an atmospheric crude distillation column.

If the first hydrocarbon feed in line 20 has greater than 1500 wppm nitrogen, the first hydrocracking reactor 12 may be preceded by a hydrotreating reactor and a separator to remove organic sulfur and nitrogen in the form of hydrogen sulfide and ammonia. The first hydrocracking reactor 12 may include a first bed or beds of hydrotreating catalyst instead of or in addition to a preceding hydrotreating reactor.

The first hydrocracking feed stream in line 24 may be heat exchanged with a hydrocracking effluent stream in hydrocracking effluent line 28 and further heated in a fired heater before entering the first hydrocracking reactor 12. In the first hydrocracking reactor 12, the first hydrocarbon stream is hydrotreated to hydrogenate sulfur and nitrogen if a separate hydrotreater does not precede the first hydrocracking reactor 12 and is then hydrocracked to lower boiling hydrocarbons in the presence of a first hydrogen stream and a hydrocracking catalyst to produce a first hydrocracked stream.

The first hydrocracking reactor 12 may comprise one or more vessels, multiple beds of catalyst in each vessel, and various combinations of hydrotreating and hydrocracking catalysts in one or more vessels.

A first hydrocracked stream exits the first hydrocracking reactor 12 and is transported in hydrocracked effluent line 28. The first hydrocracked stream may be heat exchanged with the first hydrocracking feed stream in line 24 before entering a second hydrocracking reactor 14. The second hydrocracking reactor 14 may comprise a second hydrocracking reactor vessel 14*v*. The second hydrocracking reactor 14 is in downstream communication with the first hydrocracking reactor 12. The second hydrocracking reactor 14 may include a separator 30 above one or more beds 32, 34 of hydrocracking catalyst.

In an aspect, the first hydrocracked stream enters the second hydrocracking reactor 14 near a top of the reactor vessel 14*v* and flows into the separator 30. The first hydrocracked stream is fed into the separator 30 at an inlet 28*i* that is located above a lower edge of a tubular baffle 36 that is secured to the top of the vessel 30*v*. A vapor first hydrocracked stream separates from a liquid first hydrocracked stream of the first hydrocracked stream and descends below and around the tubular baffle 36 to separate from the liquid first hydrocracked stream. The vapor first hydrocracked stream is removed from an outlet 38*o* in the top of the hydrocracking vessel located inwardly of the baffle 36 via line 38. The vapor first hydrocracked stream may be admixed with a vaporous hydrocarbonaceous stream provided via line 62 and the resulting admixed stream is carried via line 66 and introduced into a heat exchanger and perhaps a cooler. A resulting cooled and partially condensed hot separator admixed stream is introduced into a cold separator 70.

The liquid first hydrocracked stream separated in the separator 30 of the first hydrocracked stream flows downwardly onto a tray 40 that may generate a liquid level 42, such as a chimney tray. The liquid level 42 is maintained by a vertical, weir 44 which may be tubular in an aspect. A cap 46 which may be tubular also with a wider inner diameter than the tubular weir 44 is superimposed over the weir. The tubular cap 46 has a closed upper end that is opposed to an opening in the weir 44 and the tray 40 to cooperatively prevent the direct flow of liquid and any flow of undissolved vapor downwardly past the tray 40 into a mixing zone 48.

The downwardly flowing liquid first hydrocracked stream from tray 40 is admixed in the mixing zone 48 with a hereinafter described second hydrocracking feed stream in line 50 comprising recycle oil introduced into the mixing zone at a recycle inlet 50*i* below the tray 40 and the separator 30.

The recycle oil in the second hydrocracking feed stream may be mixed with the liquid first hydrocracked stream from the first hydrocracking reactor in the mixing zone 48 and may both be hydrocracked in the second hydrocracking reactor 14. The first vapor hydrocracked stream from the first hydrocracking reactor 12 comprising hydrogen sulfide and ammonia is separated from the first liquid hydrocracked stream and the second hydrogen stream in the second hydrocracking feed stream comprises scrubbed recycle gas and clean make-up gas with very little hydrogen sulfide or ammonia. The second hydrogen stream can either be mixed with the recycle oil or introduced to the second reactor 14 separately from the recycle oil stream below the separator 30. The recycle oil stream and the second hydrogen stream are kept separate from the first hydrocracked stream before the vapor first hydrocracked stream is separated from the liquid first hydrocracked stream, so that absorption of hydrogen sulfide and ammonia from the first vapor hydrocracked stream into the recycle oil stream can be minimized. Accordingly, the recycle oil stream and the second hydrogen stream are introduced to the second hydrocracking reactor 14 at inlet 50*i* which is different from the inlet 28*i* for the first hydrocracked stream and preferably at opposite sides of the tray 40 and liquid level 42. The tray 40 and the liquid level 42 prevent communication of the first vapor hydrocracked stream with the second hydrocracking feed stream comprising the recycle oil stream and the second hydrogen stream.

The resulting admixture of the second hydrocracking feed stream comprising the recycle oil stream and the second hydrogen stream and the liquid first hydrocracked stream is uniformly distributed across the entire cross section of the second hydrocracking reactor 14 by means of a distributor 52. A uniform admixture moves downwardly from distributor 52 and is introduced into the hydrocracking catalyst beds 32, 34 below the tray 40. The liquid first hydrocracked stream and the recycle oil stream are hydrocracked in the presence of the second hydrogen stream in the hydrocracking catalyst beds 32, 34 in the hydrocracking reactor vessel 14*v* to provide a second hydrocracked stream. The second hydrocracked stream is removed from the second hydrocracking reactor vessel 14*v* via second hydrocracked line 58. The second hydrocracked stream is fractionated in the fractionation section 16 to provide the recycle oil stream which is recycled to the second hydrocracking reactor 14.

The second hydrocracked stream may be heat exchanged with the second hydrocracking feed line 50 and introduced into the hot separator 60. The hot separator 60 is in downstream communication with the second hydrocracking reactor 14 and separates the second hydrocracked stream to provide a vaporous hydrocarbonaceous stream in an overhead line 62 and a liquid hydrocarbonaceous stream in a bottoms line 64. The hot separator 60 operates at about 177° C. (350° F.) to about 343° C. (650° F.) and preferably operates at about 232° C. (450° F.) to about 288° C. (550° F.). The hot separator may be operated at a slightly lower pressure than the second hydrocracking reactor 14 accounting for pressure drop. The vaporous hydrocarbonaceous stream in the overhead line 62 may be joined by the vapor first hydrocracked stream in line 38 from the separator 30 of the second hydrocracking reactor 14 and the mixed vaporous hydrocarbonaceous stream may be transported together in the combine line 66 to the cold separator 70. To prevent deposition of ammonium bisulfide or ammonium chloride salts in the line 66 transporting the vaporous hydrocarbonaceous stream, a suitable amount of wash water may be introduced into line 66 by line 68. Preferably, the mixed vaporous hydrocarbonaceous stream in the combine line 66 may be cooled before entering the cold separator 70.

The liquid hydrocarbonaceous stream in the bottoms line 64 may be further fractionated in the fractionation section 16. In an aspect, the liquid hydrocarbonaceous stream in the bottoms line 64 may be flashed in a hot flash drum 80 to provide a hot flash overhead stream in an overhead line 82 and a heavy liquid stream in a bottoms line 84. The hot flash drum 80 may be operated at the same temperature as the hot separator 60 but at a lower pressure of between about 2.1 MPa (gauge) (300 psig) and about 6.9 MPa (gauge) (1000 psig). The hot flash liquid stream in bottoms line 84 may be further fractionated in the fractionation section 16. In an aspect, the hot flash liquid stream in line 84 may be introduced into the stripping column 120 at a lower elevation than the feed point of the cold flash liquid stream in the cold flash bottoms line 114. Alternatively, the hot flash liquid stream in bottoms line 84 and the cold flash liquid stream in the cold flash bottoms line 114 may be delivered to different strippers, but this embodiment is not shown.

The cold separator 70 may be in downstream communication with the second hydrocracking reactor 14 and the overhead line 62 of the hot separator 60. The mixed vaporous hydrocarbonaceous stream comprising the vapor first hydrocracked stream and the vaporous hydrocarbonaceous stream may be separated in the cold separator 70 to provide a vaporous hydrocracking stream comprising hydrogen in an overhead line 72 and a liquid hydrocracking stream in a bottoms line 74. The cold separator may be operated at about 46° to about 63° C. (115° to 145° F.) and just below the pressure of the second hydrocracking reactor 14 accounting for pressure drop to keep hydrogen and light gases in the overhead and normally liquid hydrocarbons in the bottoms. The cold separator also has a boot for collecting an aqueous phase in line 76. The cold separator 70 serves to separate hydrogen from the mixed hydrocarbonaceous stream 66 for recycle to the first and second hydrocracking reactors 12, 14 in the overhead line 72. A portion of the liquid hydrocracking stream in cold separator bottoms line 74 and a portion of the liquid hydrocarbonaceous stream in the hot separator bottoms line 64 are fractionated to provide the recycle oil stream in line 138.

The vaporous hydrocracking stream in overhead line 72 may be scrubbed of impurities such as hydrogen sulfide with a solvent such as an amine in a scrubber 90. A lean solvent inlet line 91 delivers lean solvent to the scrubber 90 and a rich solvent outlet line 93 removes solvent rich in acid gases from the scrubber 90. The scrubbed hydrocracked stream may be compressed in a recycle compressor 92 to provide a recycle hydrogen stream in line 94. A first portion of the recycle hydrogen stream may be fed to interbed locations in the first and second hydrocracking reactors 12 and 14 as a quench and to provide hydrogen requirements. A second portion of the recycle hydrogen stream is mixed with a compressed make-up hydrogen gas stream in line 96 to provide a hydrogen supply line 98 which supplies the first and second hydrogen streams 22 and 38, respectively. The recycle compressor 92 may be in downstream communication with the overhead line 72 of the cold separator 70.

In a further aspect, a liquid hydrocracking stream in the bottoms line 74 may be transported to a cold flash drum 110. The cold flash drum 110 may be any separator that splits the liquid hydrocracking effluent into vapor and liquid fractions. The liquid hydrocracking stream in the cold separator bottoms line 74 may be mixed with the hot flash overhead stream in overhead line 82 to provide a mixed stream in mixed line 78. The mixed stream may be flashed in the cold flash drum 110. The cold flash drum may be in downstream communication with the bottoms line 74 of the cold separator 70 via the mixed line 78. The cold flash drum may be operated at the same temperature as the cold separator 70 but typically at a lower pressure of between about 1.4 MPa (gauge) (200 psig) and about 7.0 MPa (gauge) (1000 psig) and preferably 1.7 MPa (gauge) (250 psig) and about 3.4 MPa (gauge) (500 psig).

The liquid hydrocracking stream in line 74 may be introduced to the cold flash drum 110 separately from the hot flash overhead stream in overhead line 82 and mixed in the cold flash drum 110. The cold flash drum 110 produces a cold flash vapor stream in a cold flash overhead line 112 and cold flash liquid stream in a cold flash bottoms line 114 from flashing the liquid hydrocracking stream and the hot flash overhead stream. The aqueous stream in line 76 from the boot of the cold separator 70 may also be directed to the cold flash drum 110. A flash aqueous stream is removed from a boot in the cold flash drum 110 in line 116. The cold flash liquid stream in the cold flash bottoms line 114 comprising liquid from the hydrocracking effluent from both the first and second hydrocracking reactors may be further fractionated in the fractionation section 16. The cold flash liquid stream in the cold flash bottoms line 114 and the hot flash liquid stream in the hot flash bottoms line 84 may be fractionated in the fractionation section 16. The fractionation section 16 may be in downstream communication with the first hydrocracking reactor 12 and the second hydrocracking reactor 14.

The fractionation section 16 may include a stripping column 120 and a fractionation column 130. The cold flash liquid stream in the cold flash bottoms line 114 may be heated and fed to the stripping column 120. The hot flash liquid stream in the hot flash bottoms line 84 may also be heated and fed to the stripping column 120. The cold flash liquid stream which comprises at least a portion of the liquid hydrocracking stream and the hot flash liquid stream which comprises a portion of the liquid hydrocarbonaceous stream may be stripped with an inert gas such as steam from line 124 to provide a light ends stream of hydrogen, hydrogen sulfide, steam and other gases in an overhead line 122. A portion of the light ends stream may be condensed and refluxed to the stripper column 120. The stripping column 120 may be operated with a bottoms temperature between about 232° (450° F.) and about 315° C. (600° F.) and an overhead pressure of about 345 kPa (gauge) (50 psig) to about 1380 kPa (gauge) (200 psig). A stripped hydrocracked stream in a stripper bottoms line 126 may be heated in a fired heater and fed to the fractionation column 130. Consequently, the fractionation column 130 is in downstream communication with the cold flash bottoms line 114 and the hot flash bottoms line 84.

A portion of the second hydrocracked stream is fractionated in the fractionation column 130 to provide the recycle oil stream 138. The fractionation column 130 may fractionate the stripped hydrocracked stream in line 126 with heat input from an inert gas stream such as steam from line 132 to provide an overhead naphtha stream in line 134, a diesel stream carried in line 136 from a side cut outlet **136*o* and an unconverted, recycle oil stream in a bottoms line 138 which may be recycled to the second hydrocracking reactor 14. The overhead naphtha stream in line 134 may require further processing such as by catalytic reforming before blending in the gasoline pool. It is also contemplated that a further side cut that is not shown providing a separate light diesel stream or kerosene stream may be taken above a heavy diesel stream which then would be taken in diesel line 136. The fractionation column is in downstream communication with the first hydrocracking reactor 12 and the second hydrocracking reactor 14. Consequently, at least a portion of the first hydrocracked stream and the second hydrocracked stream may be fractionated to provide the diesel stream in a diesel line 136 and the recycle oil stream in bottoms line 138**.

A portion of the overhead naphtha stream in line 134 may be condensed and refluxed to the fractionation column 130. The fractionation column 130 may be operated with a bottoms temperature between about 288° C. (550° F.) and about 385° C. (725° F.), preferably between about 315° C. (600° F.) and about 357° C. (675° F.) and at or near atmospheric pressure and specifically between about 25 kPa (absolute) (3 psia) and about 240 kPa (absolute) (35 psia). A portion of the hydrocracked bottoms may be reboiled and returned to the fractionation column 130 instead of using steam stripping.

The diesel stream has an end point equivalent to the diesel cut point. The diesel stream in line 136 is reduced in sulfur content and may meet a low sulfur diesel (LSD) specification which is less than 100 wppm sulfur or an ULSD specification which is less than 10 wppm sulfur, or other specifications.

The second hydrocracking reactor 14 may be in downstream communication with the fractionation column 130. The first hydrocracking reactor is out of downstream communication with the fractionation column 130. The second hydrocracking reactor 14 may be in downstream communication with the bottoms line 138. The recycle oil stream in line 138 may be recycled by means of a pump and mixed with the second hydrogen stream comprising make-up and recycle hydrogen to provide the second hydrocracking feed stream in the second hydrocracking feed line 50. The second hydrocracking feed stream is heat exchanged with the second hydrocracked stream, heated in a furnace and fed to the second hydrocracking reactor 14 through inlet **50*i***.

In some aspects, the first hydrocracking reactor 12 and the second hydrocracking reactor 14 may each provide total conversion of at least about 20 vol-% and typically greater than about 60 vol-% of the hydrocarbon feed to products boiling below the diesel cut point. The first hydrocracking reactor 12 and the second hydrocracking reactor 14 may operate at partial conversion of more than about 50 vol-% or full conversion of at least about 90 vol-% of the feed based on total conversion.

Hydrocracking may be performed in the first hydrocracking reactor 12 and the second hydrocracking reactor 14 with the same or different hydrocracking catalysts that utilize amorphous silica-alumina bases or low-level zeolite bases combined with one or more Group VIII or Group VIB metal hydrogenating components. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite.

Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%. Platinum group metals may be used in the second hydrocracking reactor because the ammonia and hydrogen sulfide have been removed from first liquid hydrocracking effluent and the second hydrocracking stream.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° (700° F.) to about 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

The hydrocracking conditions in the first hydrocracking reactor 12 and the second hydrocracking reactor 14 may include a temperature from about 290° C. (550° F.) to about 468° C. (875° F.), preferably 343° C. (650° F.) to about 435° C. (815° F.), a pressure from about 4.8 MPa (700 psig) to about 20.7 MPa (3000 psig), a liquid hourly space velocity (LHSV) from about 0.3 to less than about 2.5 $hr^{-1}$ and a hydrogen rate of about 421 (2,500 scf/bbl) to about 2,527 $Nm^3/m^3$ oil (15,000 scf/bbl). The conditions in the first hydrocracking reactor 12 and the second hydrocracking reactor 14 may the same or different. Typically, the conditions in the second hydrocracking reactor 14 will be more severe than in the first hydrocracking reactor 12.

SPECIFIC EMBODIMENTS

While the following is described in conjunction with specific embodiments, it will be understood that this description is intended to illustrate and not limit the scope of the preceding description and the appended claims.

A first embodiment of the invention is a hydrocracking process comprising hydrocracking a first hydrocarbon stream in the presence of a first hydrogen stream and a hydrocracking catalyst to produce a first hydrocracked stream; separating the first hydrocracked stream in a hydrocracking reactor vessel to provide a vapor first hydrocracked stream and a liquid first hydrocracked stream; and hydrocracking the liquid first hydrocracked stream, a recycle oil stream in the presence of a second hydrogen stream in the hydrocracking reactor vessel to provide a second hydrocracked stream. An embodiment of the invention is one, any or all of prior embodiments in this paragraph up through the first embodiment in this paragraph further comprising fractionating a portion of the second hydrocracked stream to provide the recycle oil stream. An embodiment of the invention is one, any or all of prior embodiments in this paragraph up through the first embodiment in this paragraph further comprising separating the second hydrocracked stream in a hot separator to provide a vaporous hydrocarbonaceous stream and a liquid hydrocarbonaceous stream. An embodiment of the invention is one, any or all of prior embodiments in this paragraph up through the first embodiment in this paragraph further comprising separating the vapor first hydrocracked stream and the vaporous hydrocarbonaceous stream in a cold separator to provide a vapor hydrocracking stream and a liquid hydrocracking stream. An embodiment of the invention is one, any or all of prior embodiments in this paragraph up through the first embodiment in this paragraph further comprising fractionating a portion of the liquid hydrocracking stream and a portion of the liquid hydrocarbonaceous stream to provide the recycle oil stream. An embodiment of the invention is one, any or all of prior embodiments in this paragraph up through the first embodiment in this paragraph further comprising flashing the liquid hydrocracking stream and the liquid hydrocarbonaceous stream to provide a cold flash liquid stream and a hot flash liquid stream and fractionating the cold flash liquid stream and the hot flash liquid stream. An embodiment of the invention is one, any or all of prior embodiments in this paragraph up through the first embodiment in this paragraph wherein the recycle oil stream is provided in a bottoms line of a fractionation column. An embodiment of the invention is one, any or all of prior embodiments in this paragraph up through the first embodiment in this paragraph further comprising scrubbing the vapor hydrocracking stream to provide a recycle hydrogen stream and adding a make-up hydrogen stream to a portion of the recycle hydrogen stream to provide the first hydrogen stream and the second hydrogen stream. An embodiment of the invention is one, any or all of prior embodiments in this paragraph up through the first embodiment in this paragraph wherein the separation step requires the vapor first hydrocracked stream to descend below a baffle to separate from the liquid first hydrocracked stream.

A second embodiment of the invention is a hydrocracking apparatus comprising a first hydrocracking reactor, a second hydrocracking reactor in downstream communication with the first hydrocracking reactor; a separator in the second hydrocracking reactor; a fractionation column in downstream communication with the second hydrocracking reactor; and the second hydrocracking reactor in downstream communication with the fractionation column. An embodiment of the invention is one, any or all of prior embodiments in this paragraph up through the second embodiment in this paragraph further comprising a bottoms line from the fractionation column and the second hydrocracking reactor in downstream communication with the bottoms line. An embodiment of the invention is one, any or all of prior embodiments in this paragraph up through the second embodiment in this paragraph wherein the separator comprises a vertical baffle and a feed inlet is above a lower edge of the baffle. An embodiment of the invention is one, any or all of prior embodiments in this paragraph up through the second embodiment in this paragraph wherein the separator comprises a chimney tray with a catalyst bed below the chimney tray. An embodiment of the invention is one, any or all of prior embodiments in this paragraph up through the second embodiment in this paragraph further comprising a recycle inlet below the separator.

A third embodiment of the invention is a hydrocracking process comprising hydrocracking a first hydrocarbon stream in the presence of a first hydrogen stream and a hydrocracking catalyst to produce a first hydrocracked stream; separating the first hydrocracked stream in a hydrocracking reactor vessel to provide a vapor first hydrocracked stream and a liquid first hydrocracked stream; hydrocracking the liquid first hydrocracked stream, a recycle oil stream in the presence of a second hydrogen stream in the hydrocracking reactor vessel to provide a second hydrocracked stream; and fractionating a portion of the second hydrocracked stream to provide the recycle oil stream. An embodiment of the invention is one, any or all of prior embodiments in this paragraph up through the third embodiment in this paragraph further comprising separating the second hydrocracked stream in a hot separator to provide a vapor hot separated stream and a liquid hot separator stream; separating the vapor first hydrocracked stream and the vapor hot separated stream in a cold separator to provide a vapor cold separator stream and a liquid cold separator stream; and fractionating a portion of the liquid cold separator stream and the liquid hot separator stream to provide the recycle oil stream. An embodiment of the invention is one, any or all of prior embodiments in this paragraph up through the third embodiment in this paragraph further comprising flashing the liquid cold separator stream and the liquid hot separator stream to provide a cold flash liquid stream and a hot flash liquid stream and fractionating the cold flash liquid stream and the hot flash liquid stream. An embodiment of the invention is one, any or all of prior embodiments in this paragraph up through the third embodiment in this paragraph further comprising scrubbing the vapor cold separator stream to provide a recycle hydrogen stream and adding a make-up hydrogen stream to a recycle hydrogen stream to provide the first hydrogen stream and the second hydrogen stream. An embodiment of the invention is one, any or all of prior embodiments in this paragraph up through the third embodiment in this paragraph wherein the recycle oil stream is provided in a bottoms line a fractionation column. An embodiment of the invention is one, any or all of prior embodiments in this paragraph up through the third embodiment in this paragraph wherein the separation step requires the vapor first hydrocracked stream to descend below a baffle to separate from the liquid first hydrocracked stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A hydrocracking process comprising:

hydrocracking a first hydrocarbon stream in the presence of a first hydrogen stream and a hydrocracking catalyst to produce a first hydrocracked stream;

separating said first hydrocracked stream in a hydrocracking reactor vessel to provide a vapor first hydrocracked stream and a liquid first hydrocracked stream; and hydrocracking said liquid first hydrocracked stream, a recycle oil stream in the presence of a second hydrogen stream in said hydrocracking reactor vessel to provide a second hydrocracked stream.

2. The process of claim 1 further comprising fractionating a portion of said second hydrocracked stream to provide said recycle oil stream.

3. The process of claim 2 further comprising separating said second hydrocracked stream in a hot separator to provide a vaporous hydrocarbonaceous stream and a liquid hydrocarbonaceous stream.

4. The process of claim 3 further comprising separating said vapor first hydrocracked stream and said vaporous hydrocarbonaceous stream in a cold separator to provide a vapor hydrocracking stream and a liquid hydrocracking stream.

5. The process of claim 4 further comprising fractionating a portion of said liquid hydrocracking stream and a portion of said liquid hydrocarbonaceous stream to provide said recycle oil stream.

6. The process of claim 5 further comprising flashing said liquid hydrocracking stream and said liquid hydrocarbonaceous stream to provide a cold flash liquid stream and a hot flash liquid stream and fractionating said cold flash liquid stream and said hot flash liquid stream.

7. The process of claim 4 wherein said recycle oil stream is provided in a bottoms line of a fractionation column.

8. The process of claim 4 further comprising scrubbing said vapor hydrocracking stream to provide a recycle hydrogen stream and adding a make-up hydrogen stream to a portion of said recycle hydrogen stream to provide said first hydrogen stream and said second hydrogen stream.

9. The process of claim 1 wherein said separation step requires said vapor first hydrocracked stream to descend below a baffle to separate from said liquid first hydrocracked stream.

10. A hydrocracking apparatus comprising:

a first hydrocracking reactor;

a second hydrocracking reactor in downstream communication with said first hydrocracking reactor;

a separator in said second hydrocracking reactor;

a fractionation column in downstream communication with said second hydrocracking reactor; and said second hydrocracking reactor in downstream communication with said fractionation column.

11. The apparatus of claim 10 further comprising a bottoms line from said fractionation column and said second hydrocracking reactor in downstream communication with said bottoms line.

12. The apparatus of claim 10 wherein said separator comprises a vertical baffle and a feed inlet is above a lower edge of the baffle.

13. The apparatus of claim 10 wherein said separator comprises a chimney tray with a catalyst bed below said chimney tray.

14. The apparatus of claim 10 further comprising a recycle inlet below said separator.

15. A hydrocracking process comprising:

hydrocracking a first hydrocarbon stream in the presence of a first hydrogen stream and a hydrocracking catalyst to produce a first hydrocracked stream;

separating said first hydrocracked stream in a hydrocracking reactor vessel to provide a vapor first hydrocracked stream and a liquid first hydrocracked stream;

hydrocracking said liquid first hydrocracked stream, a recycle oil stream in the presence of a second hydrogen stream in said hydrocracking reactor vessel to provide a second hydrocracked stream; and fractionating a portion of said second hydrocracked stream to provide said recycle oil stream.

16. The process of claim 15 further comprising separating said second hydrocracked stream in a hot separator to provide a vapor hot separated stream and a liquid hot separator stream; separating said vapor first hydrocracked stream and said vapor hot separated stream in a cold separator to provide a vapor cold separator stream and a liquid cold separator stream; and fractionating a portion of said liquid cold separator stream and said liquid hot separator stream to provide said recycle oil stream.

17. The process of claim 16 further comprising flashing said liquid cold separator stream and said liquid hot separator stream to provide a cold flash liquid stream and a hot flash liquid stream and fractionating said cold flash liquid stream and said hot flash liquid stream.

18. The process of claim 17 further comprising scrubbing said vapor cold separator stream to provide a recycle hydrogen stream and adding a make-up hydrogen stream to a recycle hydrogen stream to provide said first hydrogen stream and said second hydrogen stream.

19. The process of claim 15 wherein said recycle oil stream is provided in a bottoms line a fractionation column.

20. The process of claim 15 wherein said separation step requires said vapor first hydrocracked stream to descend below a baffle to separate from said liquid first hydrocracked stream.

* * * * *